US006638324B2

(12) United States Patent
Jordan

(10) Patent No.: US 6,638,324 B2
(45) Date of Patent: Oct. 28, 2003

(54) ORGANIC CETANE IMPROVER

(75) Inventor: Frederick L. Jordan, Santa Ana, CA (US)

(73) Assignee: Oryxe Energy International, Inc., Irvine, CA (US)

( * ) Notice: Subject to any disclaimer, the term of this patent is extended or adjusted under 35 U.S.C. 154(b) by 0 days.

(21) Appl. No.: 10/084,838

(22) Filed: Feb. 26, 2002

(65) Prior Publication Data

US 2002/0194778 A1 Dec. 26, 2002

Related U.S. Application Data

(63) Continuation of application No. PCT/US01/40509, filed on Apr. 12, 2001.
(60) Provisional application No. 60/197,788, filed on Apr. 14, 2000.

(51) Int. Cl.[7] ..... C10L 1/14; C10L 1/22
(52) U.S. Cl. ..... 44/307; 44/327
(58) Field of Search ..... 44/307, 324

(56) References Cited

U.S. PATENT DOCUMENTS

| | | | | |
|---|---|---|---|---|
| 2,582,192 A | * | 1/1952 | Denison, Jr. | |
| 2,818,417 A | | 12/1957 | Brown et al. | |
| 3,018,247 A | | 1/1962 | Anderson et al. | |
| 3,438,757 A | | 4/1969 | Honnen et al. | |
| 3,524,909 A | | 8/1970 | Braus et al. | |
| 3,655,833 A | | 4/1972 | Eggensperger et al. | |
| 3,920,661 A | | 11/1975 | Ramey et al. | 260/270 |
| 3,941,745 A | | 3/1976 | Dexter et al. | 260/45.8 NT |
| 3,991,012 A | | 11/1976 | Ramey et al. | 260/45.75 N |
| 4,000,113 A | | 12/1976 | Stephen | 260/45.8 N |
| 4,007,157 A | | 2/1977 | Ramey et al. | 260/45.8 N |
| 4,051,102 A | | 9/1977 | Ramey et al. | 260/45.8 N |
| 4,077,941 A | | 3/1978 | Stephen et al. | 260/45.75 N |
| 4,081,475 A | | 3/1978 | Spivack | 560/55 |
| 4,089,842 A | | 5/1978 | Ramey et al. | 260/45.75 C |
| 4,093,586 A | | 6/1978 | Stephen | 260/45.8 N |
| 4,191,682 A | | 3/1980 | Ramey et al. | 260/45.8 N |
| 4,191,829 A | | 3/1980 | Ramey et al. | 546/222 |
| 4,207,229 A | | 6/1980 | Spivack | 260/45.8 NT |
| 4,208,190 A | * | 6/1980 | Malec | |
| 4,231,759 A | | 11/1980 | Udelhofen et al. | 44/75 |
| 4,270,930 A | | 6/1981 | Campbell et al. | 44/71 |
| 4,274,835 A | * | 6/1981 | Jordan | |
| 4,504,499 A | | 3/1985 | Finnan | |
| 4,670,021 A | | 6/1987 | Nelson et al. | 44/66 |
| 4,734,519 A | | 3/1988 | Dunski et al. | 560/75 |
| 4,806,675 A | | 2/1989 | Dunski et al. | 560/75 |
| 5,024,775 A | | 6/1991 | Hanlon et al. | 252/52 R |
| 5,076,814 A | | 12/1991 | Hanlon et al. | 44/450 |
| 5,826,369 A | * | 10/1998 | Jordan | |
| 6,193,766 B1 | * | 2/2001 | Jordan | 44/308 |

FOREIGN PATENT DOCUMENTS

EP 457589 A1 * 11/1991

OTHER PUBLICATIONS

"Oxidative Stability of Vegetable Oils in Binary Mixtures with Meadowfoam Oil," Terry et al., United States Department of Agriculture Agricultural Research Service, 1997.

Scita. G. (1992) "Stability of β–Carotene under Different Laboratory Conditions". Methods in Enzymology, 213:175–185 Academic Press, Berkeley, CA.

Scita, G. (1992) "Stability of β–Carotene under Different Laboratory Conditions". J. Natr. Biochem. 3(3):124–8.

Papadapoulous, K and Ames, J. (1995) "Proposal fo a mechanism for the inhibition of all–trans–β–cartontene autoxidation at elevated temperature by N–(2–phenylethyl)–3,4–diphenylpyrrole", *Food Chemistry* 54:251–253.

Papadopoulou, K. and Ames, J. (1994) "Kinetics of all–trans–β–Carotene Degradation of Heating with and without Phenylalanine" *JAOCS* 71:893–896.

Papadopoulou, K. and Ames, J. (1994) "Thermal Degrdtion of All–Trans–β–Carotene in the Presence of Phenylalanine" *J Sci Food Agric* 65:373–379.

Hattori et al., (1995) "β–Lactoglobulin Protects β–Ionone Related Compounds from Degradation by Heating, Oxidation, and Irradiation." *Biosci. Biotech. Biochem.* 59(12):2295–2297.

Berset, C. and Marty, C. (1992) "Formation of Nonvilatile Compounds by Thermal Degradation of β–Carotene: Protection by Antioxicants." *Methods in Enzymology* 213:129–142.

Berset, C. and Marty, C. (1986) "Use of β–carotene in extrusion–cooking. control of extrusion product color during storage" *Ind. Aliment. Agric.* 103(6), 527–32 (Published in French).

Arya et al. (1979) "Stability of β–carotene in isolated systems" *J. Fd. Technol* 14:571–578.

Desobry et al. (1997) "Comparison of Spray–drying, Drum–drying and Freeze–drying for β–Carotene Encapsulation and Preservation" *Journal of Food Scince* 62:1158–1162.

Desorbry et al. (1999) "Influence of Maltodextrin Systems at an Equivalent 25DE on Encapsulated β–carotene Loss During Stroage" *Journal of Food Processing Preservation* 23:39–55.

Selim et al. (2000) "Kinetic studies of degradation of saffron carotenoids encapsulated in amorphous polymer matrices." *Food Chemistry* 71:199–206.

(List continued on next page.)

*Primary Examiner*—Margaret Medley
(74) *Attorney, Agent, or Firm*—Knobbe Martens Olson & Bear LLP

(57) ABSTRACT

The present invention relates generally to a composition and method for increasing the amount of cetane in fuel. More specifically, it was discovered that the amount of cetane in fuel can be increased by mixing a fuel additive comprising β-carotene that was prepared in an inert atmosphere.

25 Claims, No Drawings

OTHER PUBLICATIONS

Wagner, L.A. and Warthesen, J.J. (1995) "Stability of spray–dried Encapsulated Carrot Carotenes" *Journal of food Science* 60:1048–1053.

Desobry et al. (1998) "Preservation of β–carotene from Carrots" *Critical Reviews in Food Science and Nutrition* 38(5):381–396.

Jernas, B. (1981) "Study of the effect of some antioxidants on the stability of β–carotene in an ointment containing extracts from *Flos arnicae* and *Herba calendulae" Herba Pol.* 27(1):39–43 Inst. Przem. Zielarskiego, Pozan, Pol. (Published in Polish)(Abstract).

Ochi et al. (1990) "Effects of tocopherols on deterioration of cookies blended with vegetables" *Nippon Shokuhin Kogyo Gakkaishi*. 37(1):39–44 Fac. Home Econ. Sci., Tokyo Kasei Univ., Tokyo, Japan (Published in Japanese)(Abstract).

Zhedek et al. (1970) "Tetrahydroquinone derivatives as feed antioxidants" *Sin. Issled. Eff. Khim. Polim.* Mater 4:283–8 (Published in Russian)(Abstract).

Zhedek et al (1971) "Synthesis and inhibiting properties of 3,4–dihydrosantoquin" *Zh. Prikl. Khim.* (*Leningrad*) 44(11):2599–600 (Published in Russian) (Abstract).

Alekseev et al. (1972) "Inhibition of β–carotene oxidation in an aromatic solvent" *Izv. Akac. Nauk. SSSR, Ser. Khim.* 2:312–16 (Published in Russian)(Abstract).

Alekseev et al. (1973) "Kinetics and mechanism of oxidation and stabilization of β–carotene" *Vitam. Vitam. Prep.* 232–40 (published in Russian)(Abstract).

Zhedek et al. (1971) "Efficient search for new antioxidants as stabilizers of carotene in dehydrated feeds" *Fiziol.–Biokhim. Osn. Povysh. Prod. Sel'skokhoz. Zhivotn.* 232–41 (Published in Russian)(Abstract).

* cited by examiner

ORGANIC CETANE IMPROVER

This application is a continuation, under 35 U.S.C. §120, of copending International Patent Application No. PCT/US01/40509, filed on Apr. 12, 2001 under the Patent Cooperation Treaty (PCT), which was published by the International Bureau in English on Oct. 25, 2001, which designates the U.S. and claims the benefit of U.S. Provisional Application No. 60/197,788, filed Apr. 14, 2000.

FIELD OF THE INVENTION

The present invention relates generally to a composition and method for increasing the amount of cetane in fuel. More specifically, it was discovered that the amount of cetane in fuel can be increased by mixing a fuel additive comprising β-carotene that was prepared in an inert atmosphere.

BACKGROUND OF THE INVENTION

The interest in improving fuel efficiency has become paramount as our natural resources dwindle and the cost of fuel continues to rise. Fuel efficiency can be improved by adding a fuel additive. Several existing fuel additives are known to increase fuel efficiency, for example, U.S. Pat. Nos. 4,274,835, 5,826,369, and 6,193,766 describe fuel additives that improve combustion. Despite the successes of these inventions, there still remains a need for fuel additives that improve combustion.

SUMMARY OF THE INVENTION

Embodiments of the invention described herein concern fuel additives that increase the amount of cetane in fuel and methods of use thereof. In one embodiment, for example, a method of improving the amount of cetane in a fuel comprises the step of adding a β-carotene that was dissolved in an inert atmosphere to said fuel. In another embodiment, a cetane improver is made by providing β-carotene that was dissolved in an inert atmosphere, providing an alkyl nitrate, and mixing the β-carotene with the alkyl nitrate. In aspects of this later embodiment, the alkyl nitrate is 2-ethylhexyl nitrate or the inert atmosphere is nitrogen. Additionally, this later method of making a cetane improver can further comprise the step of mixing the β-carotene with toluene prior to mixing the β-carotene with the alkyl nitrate.

Compositions of the invention can include, for example, a cetane improver made by one of the methods described above or a cetane improver comprising a non-oxygenated β-carotene. These cetane improver embodiments can also comprise an alkyl nitrate and/or a toluene. Additionally, in some compositions, the alkyl nitrate is 2-ethylhexyl nitrate. A preferred embodiment of the invention is a No. 2 diesel fuel comprising one of the cetane improvers described above.

In a first embodiment, a cetane improver is provided, the cetane improver including a non-oxygenated β-carotene.

In an aspect of the first embodiment, the cetane improver further includes an alkyl nitrate, such as 2-ethylhexyl nitrate.

In an aspect of the first embodiment, the cetane improver further includes a diluent, such as toluene.

In an aspect of the first embodiment, the cetane improver includes about 3 g β-carotene per 3785 ml of cetane improver and about 946 ml of alkyl nitrate per 3785 ml of cetane improver. The alkyl nitrate may include 2-ethylhexyl nitrate.

In a second embodiment, a diesel fuel is provided, the diesel fuel including a base fuel and a cetane improver, the cetane improver including non-oxygenated β-carotene and an alkyl nitrate.

In an aspect of the second embodiment, the alkyl nitrate includes 2-ethylhexyl nitrate.

In an aspect of the second embodiment, the diesel fuel includes from about 0.00008 g to about 0.028 g β-carotene per 3785 ml of the diesel fuel and from about 0.025 g to about 8.7 g alkyl nitrate per 3785 ml of the diesel fuel.

In an aspect of the second embodiment, the diesel fuel includes from about 0.00024 g to about 0.024 g β-carotene per 3785 ml of the diesel fuel and from about 0.075 g to about 7.5 g alkyl nitrate per 3785 ml of the diesel fuel.

In an aspect of the second embodiment, the diesel fuel includes from about 0.0004 g to about 0.020 g β-carotene per 3785 ml of the diesel fuel and from about 0.12 g to about 6.2 g alkyl nitrate per 3785 ml of the diesel fuel.

In an aspect of the second embodiment, the diesel fuel includes from about 0.0006 g to about 0.016 g β-carotene per 3785 ml of the diesel fuel and from about 0.19 g to about 5.0 g alkyl nitrate per 3785 ml of the diesel fuel.

In an aspect of the second embodiment, the diesel fuel includes from about 0.0008 g to about 0.012 g β-carotene per 3785 ml of the diesel fuel and from about 0.25 g to about 3.7 g alkyl nitrate per 3785 ml of the diesel fuel.

In an aspect of the second embodiment, the diesel fuel includes from about 0.0016 g to about 0.0095 g β-carotene per 3785 ml of the diesel fuel and from about 0.5 g to about 3 g alkyl nitrate per 3785 ml of the diesel fuel.

In an aspect of the second embodiment, the base fuel includes No. 2 diesel fuel.

In a third embodiment, a diesel fuel is provided, the diesel fuel including a base fuel and a cetane improver, the cetane improver including non-oxygenated β-carotene.

In an aspect of the third embodiment, the base fuel includes No. 2 diesel fuel.

In a fourth embodiment, a method of increasing a cetane number of a fuel is provided, the method including dissolving β-carotene in a diluent under an inert atmosphere to yield a cetane improver; and adding the cetane improver to a base fuel to yield an additized fuel, such that the cetane number of the additized fuel is higher than the cetane number of the base fuel.

In an aspect of the fourth embodiment, the base fuel includes diesel fuel, such as No. 2 diesel fuel.

In an aspect of the fourth embodiment, the base fuel further includes toluene as a diluent.

In an aspect of the fourth embodiment, inert atmosphere includes nitrogen.

In an aspect of the fourth embodiment, the method further includes the step of mixing an alkyl nitrate with the cetane improver. The alkyl nitrate may include 2-ethylhexyl nitrate.

DETAILED DESCRIPTION OF THE PREFERRED EMBODIMENT

The invention described herein concerns a composition and method for increasing the amount of cetane in fuel. In one embodiment the cetane improver comprises β-carotene that was prepared under an inert atmosphere. Unexpectedly, it was discovered that β-carotene, which was dissolved in an inert atmosphere, raised the level of cetane in No. 2 diesel fuel more effectively and maintained the raised cetane level longer than β-carotene prepared by conventional methods. In preferred embodiments, a cetane improver is prepared by mixing β-carotene that was dissolved in an inert atmosphere with a toluene carrier and an alkyl nitrate (e.g., 2-ethylhexyl nitrate). The preferred cetane improver prepared by the methods described herein increased the level of cetane in No. 2 diesel fuel in a synergistic fashion.

In a preferred form, the cetane improver can be formulated by the following method. Under an inert atmosphere, (e.g., nitrogen, helium, or argon) four grams of β-carotene (1.6 million International units of vitamin A activity per gram) are dissolved in 3.785 liters of liquid hydrocarbon carrier toluene with heating and stirring. β-Carotene dissolved or otherwise prepared under an inert atmosphere is referred to as "non-oxygenated β-carotene." The mixture of non-oxygenated β-carotene and toluene is referred to as a "B/C-toluene solution." Approximately, 946 milliliters of the B/C-toluene solution is removed. Next, approximately 946 milliliters of a 100% solution of 2-ethylhexyl nitrate (also referred to as "2-EHN") is added to the 2.839 liters of B/C-toluene solution so as to obtain a total volume of 3.785 liters. That is, approximately 25% of the starting volume of B/C-toluene is removed and replaced by an equal volume of 2-ethylhexyl nitrate.

It should be understood that pure 2-EHN is desired but that variations in alkyl nitrates and in grade are also suitable. Further, one of skill will appreciate that other alkyl nitrates are equivalent to 2-EHN and can be substituted accordingly. Desirably, many different formulations of cetane improver are made, each having a different alkyl nitrate or more than one alkyl nitrate and/or proportions thereof relative to the β-carotene, which was dissolved under an inert atmosphere, and these formulations are evaluated for the ability to raise cetane levels in No. 2 diesel fuel according to the methods described below. In the embodiment described above, it is desirable to add the ingredients in the order described above. However, in other embodiments, variations in the order of addition can be made.

The B/C-toluene-2-EHN solution is one embodiment of a "concentrated cetene improver," also referred to as "OR-CT." To improve the cetane level in No. 2 diesel fuel, approximately 0.1 ml–-35 ml of the concentrated cetane improver is added per one gallon of No. 2 diesel fuel. Preferably, the amount of concentrated cetane improver added to a gallon of No. 2 diesel fuel is, in the range from about 0.3 ml to about 30 ml, more desirably, from about 0.5 ml to about 25 ml, still more preferably, from about 0.75 ml to about 20 ml, even more preferably, from about 1 ml to about 15 ml, and most preferably, from about 2 ml to about 12 ml. The Examples described below provide the results of tests performed according to the well-accepted ASTM D-613 procedure on baseline fuels of various quality as measured by initial cetane levels. This data verifies that the cetane improver described herein synergistically improves the level of cetane in No. 2 diesel fuel.

| FORMULATION | CETANE LEVEL |
|---|---|
| Baseline fuel No. 2 Diesel | 40.5 |
| No. 2 diesel with 1057[1] ppm 2-EHN[6] only | 44.98 |
| No. 2 diesel with 1057[1] ppm OR-CT[3] only | 43.04 |
| No. 2 diesel with 528.5[2] ppm 2-EHN[6] + 528.5[2] ppm OR-CT[3] mixed | 45.39(+0.41) |

| FORMULATION | CETANE LEVEL |
|---|---|
| Baseline fuel No. 2 Diesel | 46.8 |
| No. 2 diesel fuel with 1057[1] ppm 2-EHN[6] only | 52.75 |
| No. 2 diesel fuel with 1057[1] ppm OR-CT[3] only | 50.81 |
| No. 2 diesel fuel with 528.5[2] ppm 2-EHN[6] + 528.5[2] ppm OR-CT[3] mixed | 54.02(1.27) |

| FORMULATION | CETANE LEVEL |
|---|---|
| Baseline fuel No. 2 diesel | 48.79 |
| No. 2 diesel fuel with 1057[1] ppm 2-EHN[6] only | 53.18 |
| No. 2 diesel fuel with 1057[1] ppm OR-CT[3] only | 51.13 |
| No. 2 diesel fuel with 528.5[2] ppm 2-EHN[6] + 528.5[2] ppm OR-CT[3] mixed | 54.52(+1.34) |

| FORMULATION | CETANE LEVEL |
|---|---|
| Baseline fuel No. 2 diesel | 40.5 |
| No. 2 diesel fuel with 300[4] ppm 2-EHN[6] only | 43.02 |
| No. 2 diesel fuel with 300[4] ppm OR-CT[3] only | 41.48 |
| No. 2 diesel fuel with 150[5] ppm 2-EHN[6] + 150[3] ppm OR-CT[3] mixed | 43.34(+0.32) |

[1]= 4 milliliters per gallon
[2]= 2 milliliters per gallon
[3]= 1 × $10^6$IU β-carotene
[4]= 1.14 milliliters per gallon
[5]= 0.57 milliliters per gallon
[6]= 2-ethylhexyl nitrate Although the invention has been described with reference to embodiments and examples, it should be understood that various modifications can be made without departing from the spirit of the invention. Accordingly, the invention is limited only by the following claims. All references cited herein are hereby expressly incorporated by reference in their entireties.

What is claimed is:

1. A cetane improver, the cetane improver comprising a non-oxygenated β-carotene.

2. The cetane improver of claim 1, further comprising an alkyl nitrate.

3. The cetane improver of claim 2, wherein the alkyl nitrate comprises 2-ethylhexyl nitrate.

4. The cetane improver of claim 1, further comprising a diluent.

5. The cetane improver of claim 4, wherein the diluent comprises toluene.

6. The cetane improver of claim 2, comprising about 3 g β-carotene per 3785 ml of cetane improver and about 946 ml of alkyl nitrate per 3785 ml of cetane improver.

7. The cetane improver of claim 6, wherein the alkyl nitrate comprises 2-ethylhexyl nitrate.

8. A diesel fuel, the diesel fuel comprising a base fuel and a cetane improver, the cetane improver comprising non-oxygenated β-carotene and an alkyl nitrate.

9. The diesel fuel of claim 8, wherein the alkyl nitrate comprises 2-ethylhexyl nitrate.

10. The diesel fuel of claim 8, wherein the diesel fuel comprises from about 0.00008 g to about 0.028 g β-carotene per 3785 ml of the diesel fuel and from about 0.025 g to about 8.7 g alkyl nitrate per 3785 ml of the diesel fuel.

11. The diesel fuel of claim 8, wherein the diesel fuel comprises from about 0.00024 g to about 0.024 g β-carotene per 3785 ml of the diesel fuel and from about 0.075 g to about 7.5 g alkyl nitrate per 3785 ml of the diesel fuel.

12. The diesel fuel of claim 8, wherein the diesel fuel comprises from about 0.0004 g to about 0.020 g β-carotene per 3785 ml of the diesel fuel and from about 0.12 g to about 6.2 g alkyl nitrate per 3785 ml of the diesel fuel.

13. The diesel fuel of claim 8, wherein the diesel fuel comprises from about 0.0006 g to about 0.016 g β-carotene per 3785 ml of the diesel fuel and from about 0.19 g to about 5.0 g alkyl nitrate per 3785 ml of the diesel fuel.

14. The diesel fuel of claim 8, wherein the diesel fuel comprises from about 0.0008 g to about 0.012 g β-carotene per 3785 ml of the diesel fuel and from about 0.25 g to about 3.7 g alkyl nitrate per 3785 ml of the diesel fuel.

15. The diesel fuel of claim 8, wherein the diesel fuel comprises from about 0.0016 g to about 0.0095 g β-carotene per 3785 ml of the diesel fuel and from about 0.5 g to about 3 g alkyl nitrate per 3785 ml of the diesel fuel.

16. The diesel fuel of claim 8, wherein the base fuel comprises No. 2 diesel fuel.

17. A diesel fuel, the diesel fuel comprising a base fuel and a cetane improver, the cetane improver comprising non-oxygenated β-carotene.

18. The diesel fuel of claim 17, wherein the base fuel comprises No. 2 diesel fuel.

19. A method of increasing a cetane number of a fuel, the method comprising:

dissolving β-carotene in a diluent under an inert atmosphere to yield a cetane improver; and adding the cetane improver to a base fuel to yield an additized fuel, such that the cetane number of the additized fuel is higher than the cetane number of the base fuel.

20. The method of claim 19, wherein the base fuel comprises diesel fuel.

21. The method of claim 19, wherein the base fuel comprises No. 2 diesel fuel.

22. The method of claim 19, wherein the diluent comprises toluene.

23. The method of claim 19, wherein the inert atmosphere comprises nitrogen.

24. The method of claim 19, further comprising the step of:

mixing an alkyl nitrate with the cetane improver.

25. The method of claim 24, wherein the alkyl nitrate comprises 2-ethylhexyl nitrate.

* * * * *